US005477567A

United States Patent [19]

Del Fresno

[11] Patent Number: 5,477,567

[45] Date of Patent: Dec. 26, 1995

[54] PORTABLE HYDROMASSAGE APPARATUS

[75] Inventor: Miguel L. Del Fresno, San Sebastian, Spain

[73] Assignee: Electrodomisticos Solac, S.A., Victoria, Spain

[21] Appl. No.: 227,857

[22] Filed: Apr. 15, 1994

[30] Foreign Application Priority Data

Apr. 15, 1993 [ES] Spain ..... 9301026

[51] Int. Cl.[6] ..... A61H 33/02

[52] U.S. Cl. ..... 4/559; 4/541.4

[58] Field of Search ..... 4/541.1, 541.3, 4/541.4, 559, 567, 568, 569, 570; 601/167

[56] References Cited

U.S. PATENT DOCUMENTS

| | | | |
|---|---|---|---|
| 2,559,678 | 7/1951 | Schroeter | 601/167 |
| 2,730,095 | 1/1956 | Scott | 601/167 |
| 2,733,711 | 2/1956 | Gibson | 4/541.4 |
| 3,273,560 | 9/1966 | Jacuzzi | 4/559 |
| 3,286,712 | 11/1966 | Roden | 4/541.4 X |
| 3,452,370 | 7/1969 | Jacuzzi | 4/541.3 |
| 3,534,730 | 10/1970 | Jacuzzi | 601/167 |

FOREIGN PATENT DOCUMENTS

| | | | |
|---|---|---|---|
| 0280670 | 7/1952 | Switzerland | 4/541.3 |

*Primary Examiner*—Robert M. Fetsuga
*Attorney, Agent, or Firm*—Helfgott & Karas

[57] ABSTRACT

A portable hydromassage apparatus relies on a turbine lying underwater, propelling water under pressure. The generated water jet can be directed with a hose toward the desired bodily area. The turbine is driven by a motor located outside the water-containing vessel and the motor transmits motion through a resilient shaft that is located in and protected by a cable-like sheath. The jet hose is held to a vessel surface by a suction cup. The apparatus is portable and its electric parts lie beyond contact with water. When not in use, the turbine fits into a space-conserving cradle laterally extending on the motor housing.

7 Claims, 1 Drawing Sheet

PORTABLE HYDROMASSAGE APPARATUS

OBJECT OF THE INVENTION

The invention relates to a portable hydromassage apparatus conceived and designed to be useful in any kind of suitable vessel in which the user can take a bath. To this end the portable apparatus may be disposed in any bath-tub, whence it can be moved from one place to another, taking up little space and being conveniently versatile over known apparatus used to this end.

BACKGROUND OF THE INVENTION

A great many kinds of bath-tubs are currently in the market fitted with means with which the water contained in the bath-tub is provided with movement and bubbles for the user to benefit from a hydromassage.

Otherwise, there are independent apparatuses that are fixedly mounted and that are designed to propel water into the bath-tub, thereby the massage function is carried out with pressurized water.

There are other apparatuses that, being fitted with a shell and a motor that must be located outside the bathtub, send compressed air to a sort of mat that will lie on the bottom of the bath-tub, which mat has a large number of holes through which the air leaves and consequently generates bubbles, whence the hydromassage function.

In some cases, the apparatuses are fixed, as aforesaid, and otherwise, being portable, take up quite some space and are difficult to move from one place to another.

DESCRIPTION OF THE INVENTION

The hydromassage apparatus in accordance with the invention has been designed to fully solve the above problems, being a portable apparatus that carries out the hydromassage function and relies on a turbine lying underwater, propelling the same under pressure, and wherein the water jet generated can be directed with a hose toward the desired bodily area.

The turbine is driven by a motor placed outside the vessel or bath-tub containing the water, and the motor transmits movement by a resilient shaft that is housed in and protected by a cable-like sheath.

In short, the apparatus, in addition to being portable, is adaptable to any water-containing vessel or bath-tub.

In addition, the apparatus is defined by two interrelated units or parts. The part or unit in which the motor is mounted defines a sort of cavity where the turbine, can be disposed, one part fitting into the other. The assembly as a whole is compact when not in use, taking up very little space.

The apparatus of the invention is further improved in that the electric part, viz. the part where the motor is lodged, is not in contact with the water and hence the chances of electric discharges are eliminated.

It should finally be noted that the apparatus as such has an overall conformation in which appearance has been borne in mind to define an assembly that will by no means fall out of line with the furniture of the bathroom in which it is to be used.

The unit in which the turbine is mounted is provided with a lower wide hole or window through which the water contained in the vessel in which the turbine unit is submerged, will enter. The water is propelled through an outlet mouth to which a hose can be coupled so as to direct the water jet to whichever part or area the user may wish. Entry of water into the turbine supporting unit can be adjusted by a control provided on a face or plateau with which the turbine unit is provided for such purpose.

What is considered to be the rear face of the turbine unit is also provided with a number of suction pads to duly fix the unit to one of the walls or indeed the bottom of the bath-tub or water containing vessel.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

PREFERRED EMBODIMENT OF THE INVENTION

Figure 1:
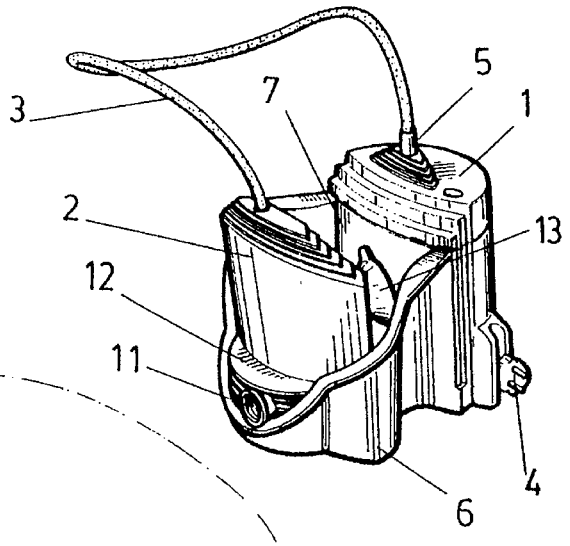
FIG. 1.—Is an overall perspective representation of the portable hydromassage apparatus subject of the invention, showing two units or parts associated to one another, one lying inside the other.
Figure 2:
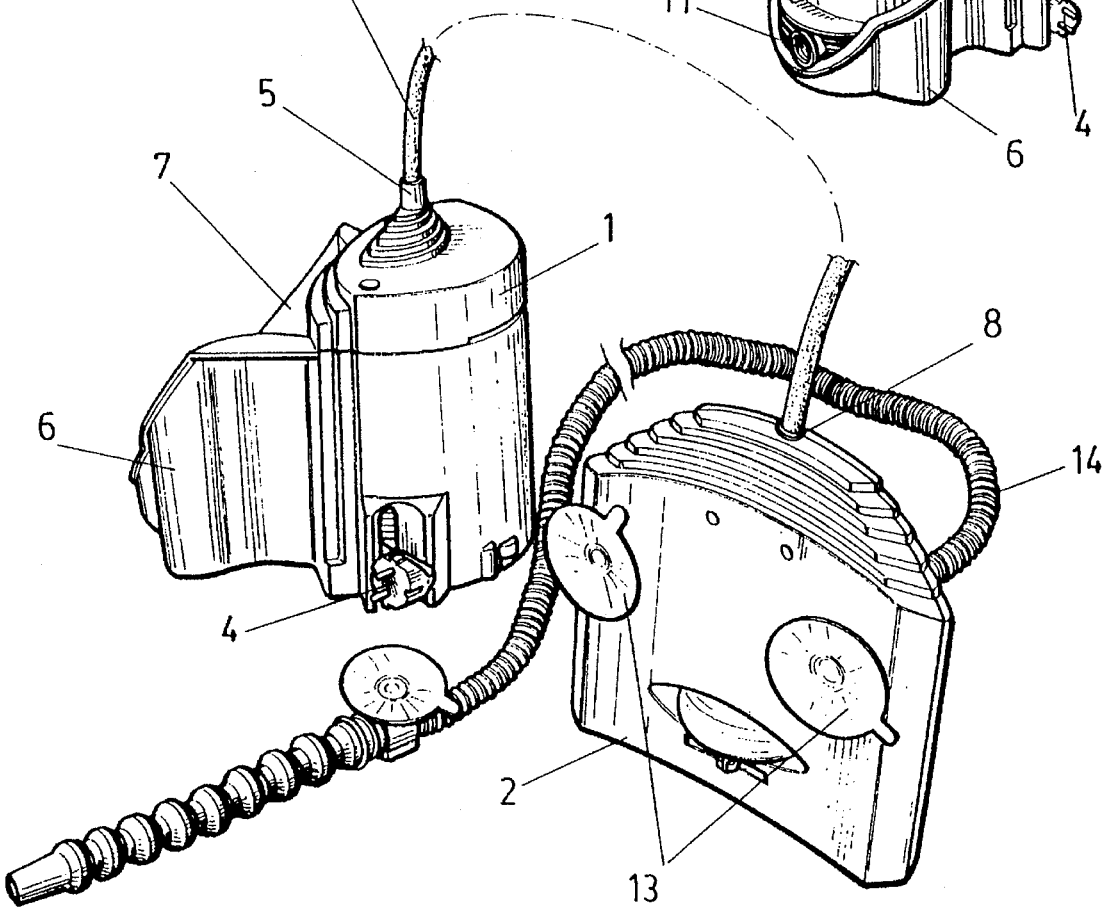
FIG. 2.—Is an overall perspective representation of the same apparatus, with the two units separated, albeit linked through the connection with which movement is transmitted from the unit including the motor to the unit including the turbine.
Figure 3:
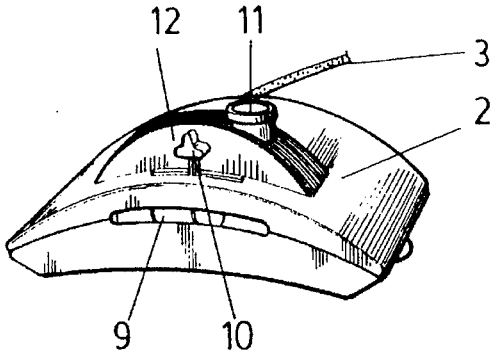
FIG. 3.—Is a perspective of the base or lower part of the turbine unit, showing the wide window or hole through which water enters, the control adjusting such inflow and the water outlet mouth.

As shown in the figures, the portable hydromassage apparatus of the invention comprises two parts or units (1) and (2) associated to each other through a resilient sheathed shaft (3), as set out hereinafter. The unit (1) is a considerably round body in which there is a drive motor powered electrically through a lead with the appropriate plug (4). From the shaft of such motor there emerges the resilient sheathed and fully watertight shaft (3) from which a turning movement is transmitted to a turbine provided inside the unit (2).

The resilient sheathed shaft (3) projects through the upper projection (5) in unit (1), the latter unit comprising side extensions (6) between which a sort of cavity (7) is defined, open at the front and in which, as shown in FIG. 1, the unit (2) can be located to make up an assembly that shall take up very little space when not in use.

As to the unit (2), the same is conformed as a sort of cylindrical sector, with a top stepped portion (8) in which precisely the resilient sheathed shaft (3) is coupled, whereas at the bottom it has a wide hole or window (9) and a control (10) with which entry of water can be adjusted through the said window (9). The unit (2) being further provided with an exit mouth (11) on what is considered as its front face, where it is moreover provided with the control (10), both lying upon an embossment (12), whereas its rear face is provided with a pair of suction pads (13) that allow the unit (2) to be fixed to any wall in a bath-tub or water-containing vessel.

A hose (14) ending in a nozzle can be coupled at the outlet mouth (11).

With this construction, the apparatus, when not in use, shall have the unit (2) housed in the cavity (7) defined in the unit (1), as shown in FIG. 1, taking up as a whole very little space.

Now then, when in use, the unit (1) will be disposed outside the water-containing vessel or bath-tub, and when plugged to the respective mains, the motor provided in the unit (1) shall start to work, driving the turbine located in the unit (2) and the latter shall have been previously inserted or submerged in the water contained in such bath-tub or vessel, whence the water drawn in by such turbine through the slot or wide hole (9) is propelled under pressure through the outlet mouth (11), causing the hydromassage effect inside the relevant vessel or bath-tub.

If the user wishes to have the benefit of this pressure water propelled through the outlet mouth (11) directed toward a particular part or area of his or her body, it shall be sufficient to couple a hose (14) having an end nozzle to the outlet mouth (11), which hose can also carry a suction pad through which it can be fixed and the jet given a particular direction without the user having to hold the hose by hand.

I claim:

1. A portable hydromassage apparatus for use in a bathtub containing water, comprising:

a first unit including a shell and an electric drive motor within said shell;

a second unit including an internal turbine having an inlet and an outlet for pumping water, said second unit being submergible in said bathtub;

a shaft in a resilient, water-tight sheath, connecting between said motor in said first unit and said turbine in said second unit and permitting selectable positioning of the two units relative to each other, operation of said motor via said shaft causing said turbine to rotate and, when submerged, draw water into said inlet and to expel a water jet from said outlet, said shell of said first unit having an external cradle with an internal surface, said cradle extending from a lateral surface of said shell, said second unit having an external surface, said second unit being receivable in said cradle with said cradle internal surface opposing said second unit external surface, said internal and external surfaces being generally complementary in contour, whereby a compact assembly is formed when said second unit is received in said cradle of said first unit.

2. A portable hydromassage apparatus as in claim 1, wherein said shaft remains in its connecting state between said first and second units when said second unit is received in said cradle, whereby said apparatus can be quickly placed into an active mode of providing hydromassage.

3. A portable hydromassage apparatus as in claim 1, wherein said shell is laterally provided with extensions defining said cradle wherein said second unit is housed during storage of said apparatus.

4. A portable hydromassage apparatus as in claim 1, wherein said turbine includes a lower base having said inlet, said inlet being an opening for water to enter, the size of said opening being adjustable by a hand driven control provided on a housing of said turbine.

5. A portable hydromassage apparatus as in claim 1, wherein said second unit includes suction pads on a rear face of said second unit for fixing said second unit to a surface of said bathtub during use, said second unit further including coupling means at said turbine outlet for connection to a hose.

6. A portable hydromassage apparatus as in claim 1, wherein a cross section of said second unit is approximately a segment of an annulus, said external surface of said second unit being concave and arcuate, said internal surface of said cradle being arcuate and convex, whereby a compact assembly of said first and second units is achieved when said cradle receives said second unit.

7. A portable hydromassage apparatus as in claim 5, and further comprising:

a hose for connection at one end to said turbine outlet coupling means, another end of said hose being free; and a suction cup attached to said hose between said turbine coupling means and said free end, whereby said hose may be held in a fixed position in said bathtub.

* * * * *